US008878084B2

(12) United States Patent
Urakami

(10) Patent No.: US 8,878,084 B2
(45) Date of Patent: Nov. 4, 2014

(54) MOVABLE CONTACT HOLDER

(75) Inventor: Shuhei Urakami, Makinohara (JP)

(73) Assignee: Yazaki Corporation, Tokyo (JP)

( * ) Notice: Subject to any disclaimer, the term of this patent is extended or adjusted under 35 U.S.C. 154(b) by 121 days.

(21) Appl. No.: 13/389,153

(22) PCT Filed: May 11, 2010

(86) PCT No.: PCT/JP2010/058253

§ 371 (c)(1),
(2), (4) Date: Feb. 6, 2012

(87) PCT Pub. No.: WO2011/016276

PCT Pub. Date: Feb. 10, 2011

(65) Prior Publication Data

US 2012/0135628 A1 May 31, 2012

(30) Foreign Application Priority Data

Aug. 7, 2009 (JP) ..... 2009-184733

(51) Int. Cl.

| | |
|---|---|
| ***H01H 1/14*** | (2006.01) |
| ***H01H 1/44*** | (2006.01) |
| ***H01C 10/36*** | (2006.01) |
| ***H01H 1/48*** | (2006.01) |
| *H01H 19/10* | (2006.01) |
| *H01H 1/26* | (2006.01) |

(52) U.S. Cl.

CPC ..... *H01H 1/44* (2013.01); *H01C 10/36* (2013.01); *H01H 19/10* (2013.01); *H01H 2001/265* (2013.01); *H01H 1/48* (2013.01)

USPC ..... 200/239; 439/65; 439/74

(58) Field of Classification Search

CPC ..... H01R 13/24

See application file for complete search history.

(56) References Cited

U.S. PATENT DOCUMENTS 3,748,419 A 7/1973 Torrey et al.
6,113,440 A * 9/2000 Fijten et al. ..... 439/862

(Continued)

FOREIGN PATENT DOCUMENTS

JP 50-79940 A 7/1975
JP 63-124708 A 8/1988

(Continued)

OTHER PUBLICATIONS

International Search Report and Written Opinion for PCT/JP2010/058253 issued Jun. 15, 2011.

(Continued)

*Primary Examiner* — Vanessa Girardi

(74) *Attorney, Agent, or Firm* — Edwards Wildman Palmer LLP

(57) ABSTRACT

A movable contact includes a contact base and a contact body upstanding from an end of the contact base. The holder includes a first holding portion constructed to hold the contact base such that the first holding portion is in contact with one surface of the contact base, the surface being opposite an other surface of the contact base from which the movable contact upstands, a second holding portion constructed to hold the contact base such that the second holding portion is in contact with the other surface of the contact base at a distal end of the contact base with reference to the contact body, and a disengagement-prevention portion provided at a proximal end of the contact base with reference to the contact body, on the one side of the contact base, and spaced away from the contact base, and constructed to prevent the movable contact from being detached from the holder.

6 Claims, 4 Drawing Sheets

(56) References Cited

U.S. PATENT DOCUMENTS

| | | | | |
|---|---|---|---|---|
| 6,222,144 | B1 | 4/2001 | Nishikawa | |
| 2003/0011461 | A1 | 1/2003 | Yu | |
| 2007/0287311 | A1 * | 12/2007 | Ma | 439/159 |

FOREIGN PATENT DOCUMENTS

| | | | | |
|---|---|---|---|---|
| JP | 9-185928 | A | 7/1997 | |
| JP | 2000-067694 | A | 3/2000 | |
| JP | 200067694 | * | 3/2000 | H01H 15/06 |
| JP | 2007-026940 | A | 2/2007 | |

OTHER PUBLICATIONS

Japanese Office Action dated Jun. 11, 2013 in corresponding application 2009-184733.

The extended European search report dated on Feb. 13, 2014 for corresponding European Patent Application No. 10806276.1.

Office Action dated Nov. 5, 2013, issued for corresponding Chinese patent application No. 201080034894.6.

* cited by examiner

FIG. 4 -- Prior Art --
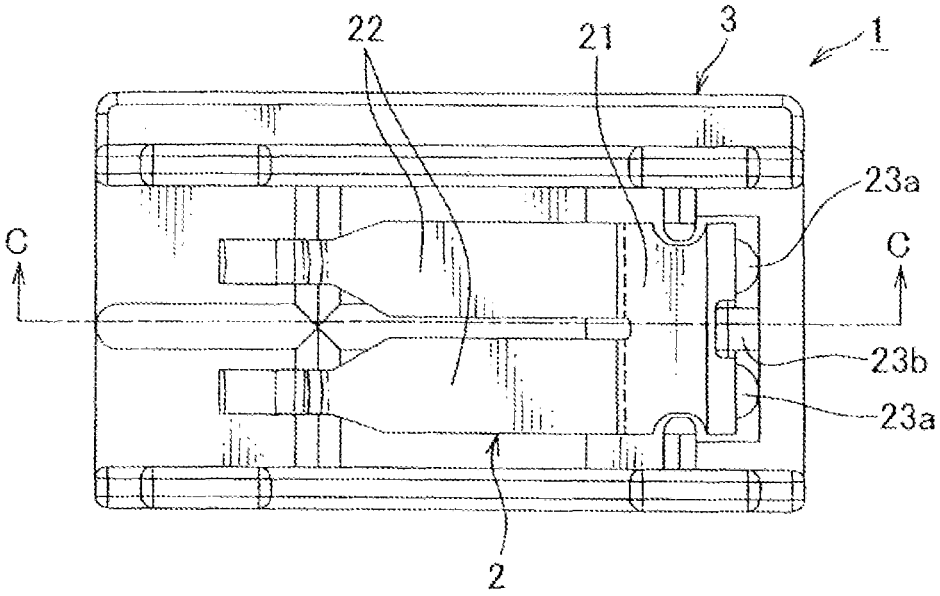
FIG. 5 -- Prior Art --
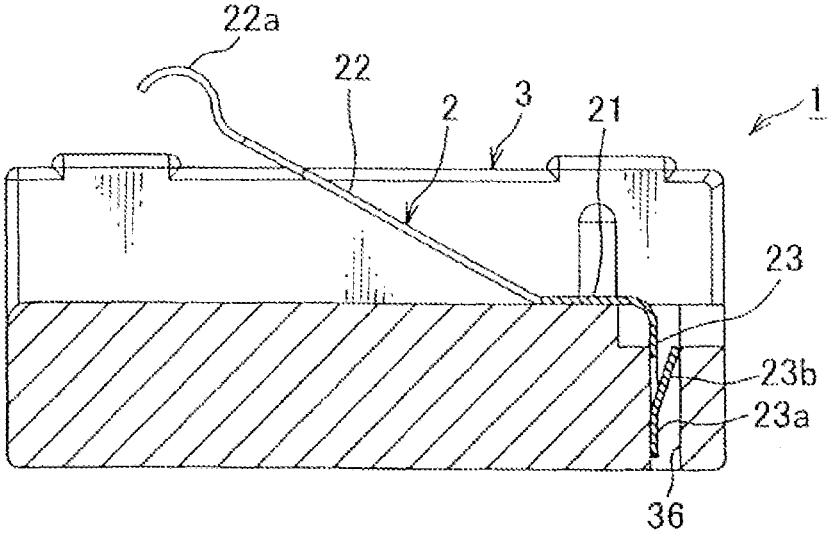

FIG. 6 -- Prior Art --
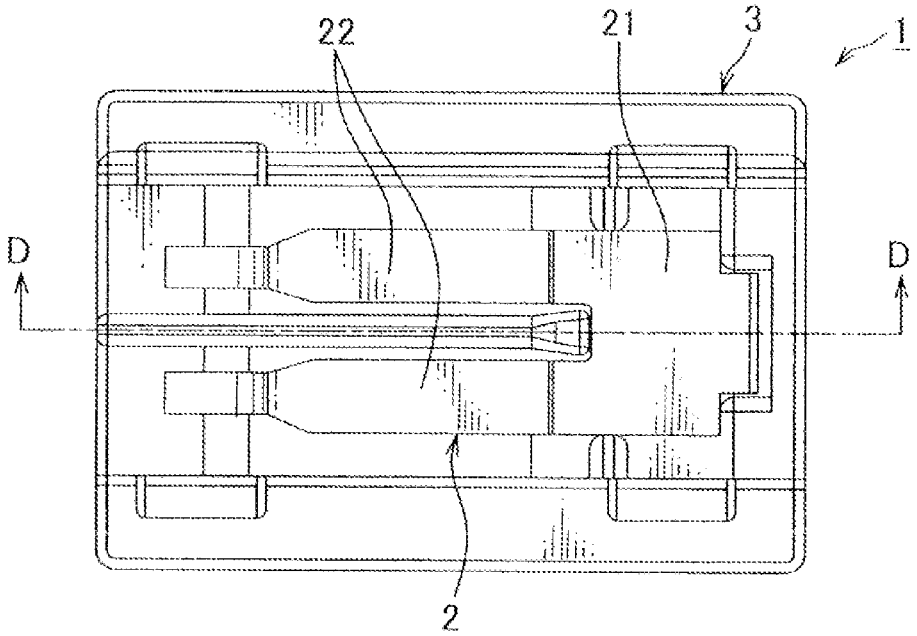
FIG. 7 -- Prior Art --
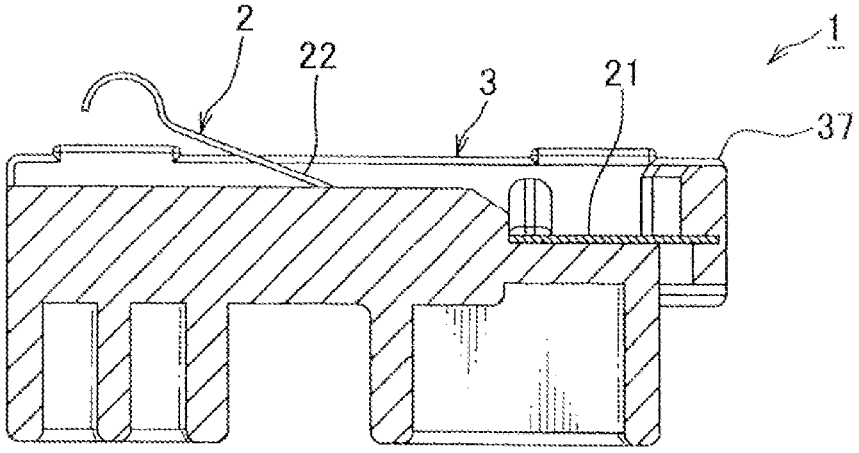

MOVABLE CONTACT HOLDER

TECHNICAL FIELD

The present invention generally relates to a contact device, and in particular to a contact device that includes a movable contact including a plate-like contact base and a contact body upstanding from an end of the same contact base, and a holder that holds the contact base of the movable contact.

BACKGROUND ART

The contact device is incorporated, for example, in a rotation sensor adapted to sense a rotational position of a rotating body. The rotation sensor makes a movable contact of the contact device slide on a resistive body in response to the rotation of the rotating body, detects a value of resistance between an end of the resistive body and the movable contact, and thus determines the rotational position of the rotating body.

As a known example of the contact device of this kind, a conventional contact device 1 is illustrated in FIGS. 4 and 5. As shown in these figures, the contact device 1 includes an electrically-conductive movable contact 2 made by a pressed metal sheet, and a holder 3 made of electrical-insulating resin and adapted to hold the movable contact 2. The movable contact 2 includes a plate-like contact base 21 and a contact body 22 obliquely upstanding from an end of the contact base 21.

A distal end of the contact base 21 ("distal" or "proximal" being defined with reference to the contact body 22) is bent downward by 90 degrees relative to a plane from which the contact bodies upstand, the distal end defining a 90-degrees-bent fixing portion 23. The fixing portion 23 includes a pair of raised portions 23*a* made by press working, and a resilient piece 23*b* made by cutting and raising a region of the fixing portion 23 between the raised portions 23*a*. The contact body 22 includes at its tip a contacting portion 22*a* made in a convex shape by press working. The contacting portion 22*a* is adapted to be slid on the resistive body.

The holder 3 shown in FIG. 5 includes a vertical hole 36 into which the fixing portion 23 of the movable contact 2 is inserted. When the fixing portion 23 of the movable contact 2 is inserted into the vertical hole 36, the pair of raised portions 23*a* provided on the fixing portion 23 is press-fit into the vertical hole 36, and the resilient piece 23*b* provided on the fixing portion 23 biases the inner wall of the vertical hole 36. Thus, the movable contact 2 is secured and prevented from being detached from the holder 3.

SUMMARY OF THE INVENTION

Technical Problem

In the conventional contact device 1, the distal end (with reference to the contact body 22) of the contact base 21 has to be bent by 90 degrees so as to secure the movable contact 2 to the holder 3. Due to this configuration, it is necessary to provide the vertical hole 36 in the holder 3, which causes the holder 3 to become thick and large.

Another conventional device shown in FIGS. 6 and 7 may be conceivable with a view to address the above-identified problem (in these figures, the same or equivalent elements has the same reference signs as in the contact device 1 shown in FIG. 4 and FIG. 5 with detailed explanation omitted). As shown in the same figures, the distal end (this end is defined "distal" with reference to the contact body 22) of the contact base 21 is not bent, and the contact base 21 does not include the fixing portion 23. In addition, the holder 3 includes a retaining groove 37 configured to hold the distal end of the contact base 21 (this end is defined "distal" with reference to the contact body 22) with the distal end fit into the retaining groove 37.

In the contact device 1 shown in FIGS. 6 7, however, a proximal end (the end is defined "proximal" with respect to the contact body 22) of the contact base 21 is not fixed. Due to this, when the contact device 1 is mounted, for example, to the rotation sensor with a proximal side of the contact base 21 (with reference to the movable contact 2) oriented in a perpendicularly downward direction, the distal end of the contact base 21 (with reference to the contact body 22) may be detached from the retaining groove 37 and, as a result, the movable contact 2 might be detached from the holder 3 which degrades installing characteristic. This means that, in the conventional contact device 1, miniaturization and improved installing characteristic fail to go hand-in-hand with each other.

In view of the above-identified problems, an object of the present invention is to provide a contact device that has a more reduced size and more improved installing characteristic.

Solution to Problem

In order to address the above-identified problem, a contact device according to a first aspect of the present invention includes (A) a movable contact including a plate-like contact base and a contact body upstanding from an end of the contact base, and (B) a holder constructed to hold the contact base of the movable contact, the holder including (a) a first holding portion constructed to hold the contact base, the first holding portion being in contact with one surface of the contact base, the surface being opposite an other surface of the contact base from which the contact body upstands, (b) a second holding portion constructed to hold the contact base, the second holding portion being in contact with the other surface of the contact base at a distal end of the contact base, the distal end being distal with reference to the contact body, and (c) a disengagement-prevention portion residing above a proximal end of the one surface of the contact base, the proximal end being proximal with reference to the contact body, and the disengagement-prevention portion being configured to prevent the movable contact from being detached from the holder.

The contact device according to a second aspect of the present invention further includes a protruding section provided at the proximal end of the contact base with reference to the contact bodies such that the disengagement-prevention portion resides in a space above the one surface of the contact base.

In the contact device according to a third aspect in addition to the second aspect of the present invention, a pair of the contact bodies are juxtaposed to each other, and the protruding section is provided between the pair of the contact bodies.

Advantageous Effects of the Invention

In the contact device according to the first aspect of the present invention as discussed in the foregoing, when the contact body is slid on a resistive body, the elasticity of the contact body causes a force to bias the base toward the first holding portion and the second holding portion, so that the base is held by the holder. Accordingly, the holder can hold the movable contact without the aid of any raised portions or resilient pieces provided on the movable contact. Further-more, when the contact device is mounted to a rotation sensor, the proximal end of the base ("proximal" with reference to the contact body) is inclined in the upstanding direction in which the contact bodies upstands is brought into abutment with the disengagement-prevention portion, and the movable contact is prevented from being inadvertently detached from the holder, thus it is possible to achieve miniaturization and improved installing characteristic of the contact device.

In the contact device according to the second aspect of the present invention, by virtue of the protruding section provided on the end of the base, it is possible to attach the movable contact to the holder by holding the protruding section, and accordingly it is not necessary to attach the movable contact to the holder by holding the contact bodies so that adverse effects upon the functionality of the contact body is eliminated.

In the contact device according to the third aspect of the present invention, the protruding section provided between the pair of contact bodies allows further miniaturization of the device and effective prevention of inadvertent detachment.

BRIEF DESCRIPTION OF THE DRAWINGS

In the drawings:

FIG. 4 is a top view of an exemplary conventional contact device.

FIG. 5 is a cross-sectional view of the contact device of FIG. 4 taken along the line C-C.

FIG. 6 is a top view of another exemplary conventional contact device.

FIG. 7 is a cross-sectional view of the contact device of FIG. 6 taken along the line D-D.

DESCRIPTION OF THE EMBODIMENT

Figure 1:
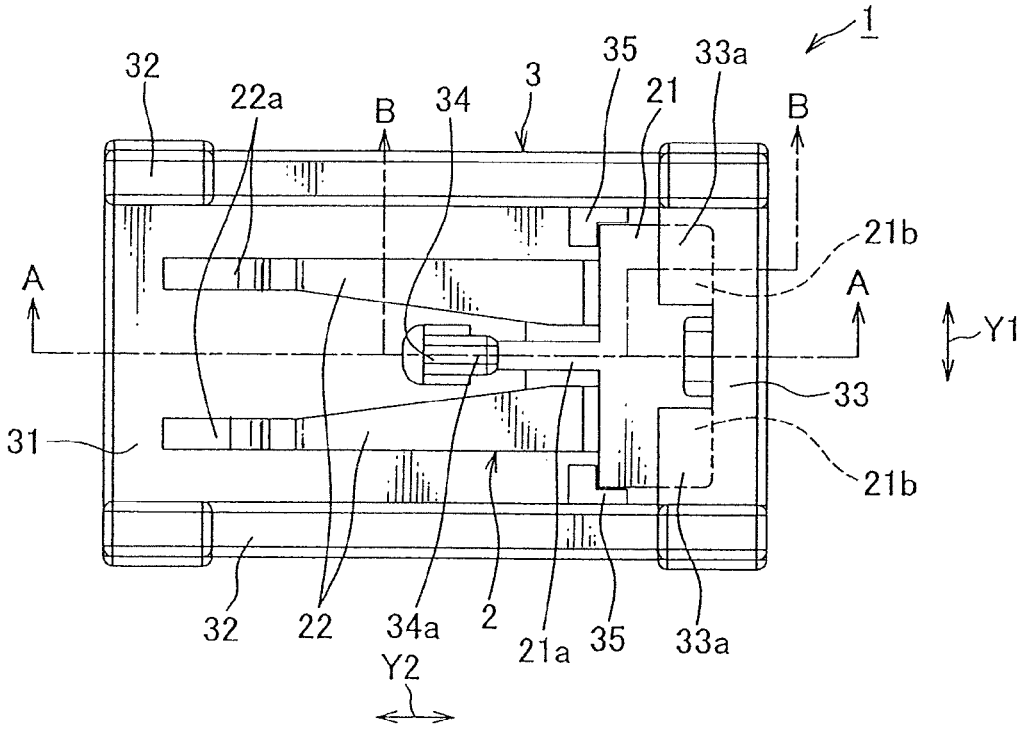
FIG. 1 is a top view of a contact device according to one embodiment of the present invention.
Figure 2:
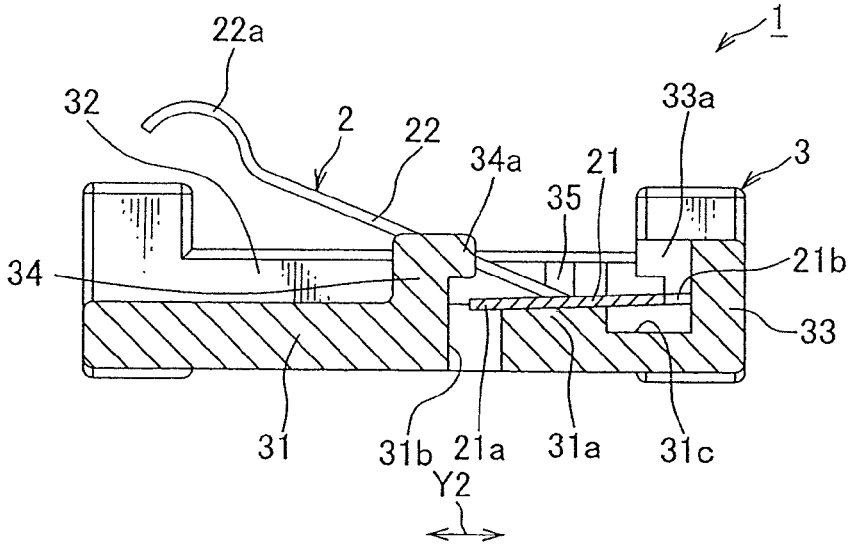
FIG. 2 is a cross-sectional view of the contact device of FIG. 1 taken along the line A-A.
Figure 3A:
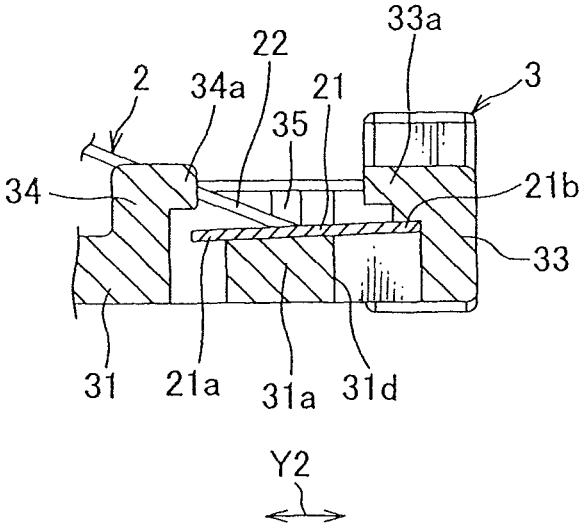
FIG. 3A is a cross-sectional view of the contact device of FIG. 1 taken along the line B-B, where the contact device is in a normal state.

The following describes an embodiment of the present invention with reference to FIG. 1 to FIG. 3.

As shown in the figures, a contact device 1 includes (A) a movable contact 2 made of an electrically-conductive metal sheet endured the process of press working, and (B) a holder 3 made of an electrical-insulating material such as a synthetic resin and adapted to hold the movable contact 2.

The movable contact 2 includes (1) a plate-like contact base 21 and (2) a pair of contact bodies 22 upstandingly extending from an end of the contact base 21.

The contact base 21 of the movable contact 2 includes (a) first protruding section 21*a* (which is a "protruding section" in the context of the scope of claims) protruding from a proximal end (defined as "distal" with reference to the contact body 22) of the contact base 21 (which is found in a left portion in the figure), and (b) a pair of second protruding sections 21*b* protruding from a distal end of the contact base 21 distal with reference to the contact body 22 (which is found in a right portion in the figure).

The first protruding section 21*a* protrudes between the pair of contact bodies 22, and the pair of second protruding sections 21*b* are juxtaposed to each other in an alignment direction Y1 (in FIG. 1) of the pair of contact bodies 22 of the contact base 21.

The pair of contact bodies 22 are each provided such that a width thereof decreases as they taper toward their tip. Also, the pair of the contact bodies 22 each include a contacting portion 22*a* made in a convex shape through press working, the contacting portion 22*a* configured to be slid on a resistive body which has been described in the discussion of the prior art.

The holder 3 includes a bottom wall 31; upstanding walls 32 upstandingly extending from both ends of the bottom wall 31 in the alignment direction Y1; an upstanding wall 33 upstandingly extending from an end of the bottom wall 31 on a distal side of the holder 3 with reference to the contact body 22; an upstanding wall 34 upstanding substantially at a centre of the bottom wall 31; and a pair of L-shaped positioning ribs 35 upstandingly provided from the bottom wall 31.

Referring to FIG. 2, a first holding portion 31*a* in contact with an undersurface of the contact base 21 is provided on the bottom wall 31 of the holder 3, the undersurface being opposite an upper surface of the contact base 21 from which the contact bodies 22 upstandingly extend (which is found in a central bottom portion in FIG. 2). The first holding portion 31*a* is configured to hold the contact base 21.

Also, there is provided a throughhole 31*b* in a portion of the bottom wall 31 of the holder 3 such that the throughhole 31*b* is opposed to an end of the first protruding section 21*a*. Since there exists the through hole 31*b*, the proximal end of the first protruding section 21*a* is not held by the bottom wall 31.

Also, a recessed portion 31*c* is provided on a portion of the bottom wall 31 of the holder 3, the portion being opposed to a distal end of the contact base 21 (distal with reference to the contact body 22). Since there exists the recessed portion 31*c*, the distal end of the contact base 21 (distal with reference to the contact body 22) is not held by the bottom wall 31.

Referring further to FIG. 3, a throughhole 31*d* is provided in a portion of the bottom wall 31 of the holder 3, the portion being opposed to the second protruding sections 21*b*. Since there exists the throughhole 31*d*, the second protruding sections 21*b* of the contact base 21 is not held by the bottom wall 31.

Referring again to FIG. 2, the upstanding wall 33 is constructed and arranged to abut against end surfaces of the pair of second protruding sections 21*b* and adjust positioning of the contact base 21 with respect to a longitudinal direction Y2 of the contact bodies 22.

The upstanding wall 33 includes a pair of second holding portions 33*a* extending toward the contact body 22. Each of the pair of second holding portions 33*a* is constructed to be in contact with an upper surface of the second protruding sections 21*b* corresponding to the upper surface of the contact base 21 from which the contact bodies extend in the upstanding direction (in a central upper portion of FIG. 2) to hold the contact base 21.

The upstanding wall 34 protrudes at an edge of the throughhole 31*b* and is arranged in more proximate to the contact body 22 than the first protruding section 21*a* is. The upstanding wall 34 is spaced from a surface of the end of the first protruding section 21*a*. Also, the upstanding wall 34 includes a disengagement-prevention portion 34*a* protruding away from the contact body 22.

The disengagement-prevention portion 34*a* resides in a space above the upper surface of the first protruding section 21*a* (in the upstanding direction of the contact bodies 22), i.e., in a space found in the central upper portion in FIG. 2). The disengagement-prevention portion 34*a* and the first protruding section 21*a* are spaced from and opposed to each other in the upstanding direction.

Referring again to FIG. 1, each of the pair of positioning ribs 35 is constructed to abut on a surface of the proximal end of the contact base 21 (where the contacting parts 22 upstand) and on a lateral surface of the proximal end of the contact base 21 in the alignment direction Y1. The positioning ribs 35 are configured to adjust positioning of the contact base 21 in the alignment direction Y1 and in the longitudinal direction Y2.

The contact device 1 having the above-described construction and arrangement may be incorporated into a rotation sensor. When the contacting portion 22*a* of the contact body 22 is slid on the not-shown resistive body, then the proximal end of the contact base 21 with reference to the contact body 22 is biased toward the first holding portion 31*a* by virtue of elasticity of the contact body 22.

In this manner, when the proximal end of the contact body 22 (proximal with reference to the contact base 21) is biased toward the first holding portion 31*a*, then the second protruding sections 21*b* of the contact base 21 is elevated in the upstanding direction (toward a central upper portion in FIG. 2), and the second protruding sections 21*b* is biased toward the second holding portion 33*a*. By virtue of this feature, in contrast to a conventional device, the contact base 21 does not need to include a resilient piece or a raised portion, and firm retention force by the holder 3 is exerted on the movable contact 2.

Figure 3B:
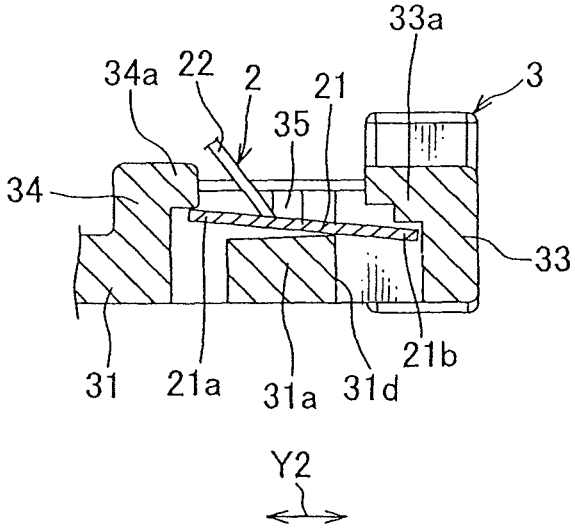
FIG. 3B is a cross-sectional view of the contact device of FIG. 1 taken along the line B-B, where a base is inclined.

Also, the movable contact 2 is not biased as long as the contact device 1 is yet to be attached to the rotation sensor. By virtue of this feature, when the contact device 1 is about to be attached to the rotation sensor as shown in FIG. 3B, the proximal end of the contact base 21 (defined as proximal with reference to the contact bodies 22) may be inclined in the upstanding direction and it may happen that the contact base 21 is inadvertently detached from the holder 3. However, even if it really happens, since the contact base 21 of this embodiment that has inclined will abut against the disengagement-prevention portion 34*a*, so that the movable contact 2 is prevented from being detached from the holder 3. Accordingly, it is possible to ensure miniaturization and improve installing characteristic (of the contact device 1).

Also, according to the contact device 1, it is by virtue of the first protruding section 21*a* provided at the proximal end of the contact base 21 (proximal with reference to the contact body 22) that it is possible to mount the movable contact 2 to the holder 3 by holding the first protruding section 21*a*. The contact body 22 does not need to be grasped for attaching the movable contact 2 to the holder 3, so that adverse effects and impacts including decreased functionality of the contact body 22 can be avoided.

Further, according to the contact device 1, it is by virtue of the first protruding section 21*a* provided between the pair of contact bodies 22 that it is possible to provide a more reduced size of the device and prevent disengagement more effectively.

The first protruding section 21*a* of this embodiment is provided at the proximal end of the contact base 21 (with reference to the contact body 22) so that abutment of the first protruding section 21*a* against the disengagement-prevention portion 34*a* ensures prevention of the disengagement of the holder 3 taken out of the movable contact 2. Notwithstanding the described configuration, the present invention is in no way limited to the illustrated embodiment. For example, the first protruding section 21*a* may be omitted, and the disengagement-prevention portion 34*a* alone, which is brought into abutment against the upper surface of the contact base 21 where the contact body 22 is provided, can also ensure prevention of the disengagement.

Although the first protruding section 21*a* in this embodiment is provided between the pair of the contact bodies 22, the present invention is in no way limited to the illustrated embodiment. For example, if an increased size is allowable, a pair of the first protruding sections 21*a* may each be provided on both sides in the alignment direction Y1 of the pair of the contact bodies 22.

The embodiment that has been illustrated in the foregoing is merely a typical and exemplary one of the embodiments of the present invention and the present invention should not be construed as being limited to the illustrated embodiment. That is, the present invention can be effectuated with various modifications within the scope and spirit of the present invention.

REFERENCE SIGNS

1 Contact device
2 Movable contact
3 Holder
21 Contact base
21*a* First protruding section (protruding section)
22 Contact part
31*a* First holding portion
33*a* Second holding portion
34*a* Disengagement-prevention portion

The invention claimed is:

1. A contact device comprising:

a movable contact including: a plate-like contact base; a contact body projecting upward from an end of the contact base; and a protruding section provided at the end of the contact base in a same plane as the contact base, and a holder including: a first holding portion supporting the contact base from below; a second holding portion supporting a distal end of the contact base from above; and a disengagement-prevention portion residing above, spaced from, and oppose to the protruding section, wherein the protruding section abuts against the disengagement-prevention portion when the contact base is inclined and detached from the second holding portion.

2. The contact device according to claim 1, wherein the protruding section is disposed between a pair of the contact bodies juxtaposed to each other.

3. The contact device according to claim 1, wherein the contact base is in contact with only an edge of the first holding portion when the contact base is inclined.

4. The contact device according to claim 1, wherein the second holding portion is spaced from and opposes to the disengagement-prevention portion, and the first holding portion is located therebetween.

5. A contact device comprising:

a movable contact including a plate-like contact base and a pair of contact bodies upstanding from a proximal end of the contact base; and a holder constructed to hold the contact base of the movable contact, wherein a protruding section is provided at the proximal end of the contact base with reference to the contact bodies such that the protruding section and the contact base are formed on a same plane, the holder including a first holding portion constructed to hold the contact base, the first holding portion being in contact with one surface of the contact base, the surface being opposite an other surface of the contact base from which the contact bodies project upward, a second holding portion constructed to hold the contact base, the second holding portion being in contact with the other surface of the contact base at a distal end of the contact base, the distal end being distal with reference to the contact bodies, and a disengagement-prevention portion residing above a proximal end of the one surface of the contact base, the proximal end being proximal with reference to the contact bodies, and the disengagement-prevention portion being configured to prevent the movable contact from being detached from the holder, wherein the disengagement-prevention portion and the protruding section are spaced from and oppose to each other in the upstanding direction, and abutment of the protruding section against the disengagement-prevention portion ensures prevention of the disengagement of the movable contact taken out from the holder, when the contact base is inclined, and the pair of the contact bodies is juxtaposed to each other with the protruding section disposed therebetween.

6. A contact device comprising:

a movable contact including a plate-like contact base and a contact body upstanding from an end of the contact base; and a holder constructed to hold the contact base of the movable contact, wherein a protruding section is provided at the end of the contact base in a same plane as the contact base, the holder including a first holding portion constructed to hold the contact base, the first holding portion being in contact with one surface of the contact base, the surface being opposite an other surface of the contact base from which the contact body projects upward, a second holding portion constructed to hold the contact base, the second holding portion being in contact with the other surface of the contact base at a distal end of the contact base, the distal end being distal with reference to the contact body, and a disengagement-prevention portion residing above the protruding section, the disengagement-prevention portion being configured to prevent the movable contact from being detached from the holder, wherein the disengagement-prevention portion and the protruding section are spaced from and oppose to each other in an upstanding direction, and abutment of the protruding section against the disengagement-prevention portion ensures prevention of the disengagement of the movable contact taken out from the holder, when the contact base is inclined.

* * * * *